US007217177B2

(12) United States Patent
Frech et al.

(10) Patent No.: US 7,217,177 B2
(45) Date of Patent: May 15, 2007

(54) GRINDING-DISK RECEIVING ELEMENT ESPECIALLY FOR A HAND-GUIDED ELECTRIC GRINDING TOOL

(75) Inventors: Alfred Frech, Leinfelden-Echterdingen (DE); Tobias Lutz, Filderstadt (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/554,014

(22) PCT Filed: Sep. 24, 2004

(86) PCT No.: PCT/DE2004/002126

§ 371 (c)(1),
(2), (4) Date: Oct. 11, 2005

(87) PCT Pub. No.: WO2005/049277

PCT Pub. Date: Jun. 2, 2005

(65) Prior Publication Data

US 2006/0217048 A1 Sep. 28, 2006

(30) Foreign Application Priority Data

Nov. 11, 2003 (DE) ..... 103 52 501

(51) Int. Cl.
*B24B 23/03* (2006.01)

(52) U.S. Cl. ..... 451/359; 451/357; 451/508

(58) Field of Classification Search ..... 451/508, 451/510, 357, 359, 360
See application file for complete search history.

(56) References Cited

U.S. PATENT DOCUMENTS 3,496,680 A * 2/1970 Hutchins ..... 451/357
6,309,288 B1 * 10/2001 Chung ..... 451/359
6,780,093 B2 * 8/2004 Krondorfer et al. ..... 451/344

FOREIGN PATENT DOCUMENTS

DE 199 14 956 A1 10/2000

* cited by examiner

*Primary Examiner*—Robert A. Rose
(74) *Attorney, Agent, or Firm*—Michael J. Striker

(57) ABSTRACT

With a sanding-disc receiving element for a hand-guided electric sanding tool, an eccentric sander (15) in particular, the sanding-disc receiving element including a bearing flange (2) with a plurality of driving lugs (3) protruding in the axial direction around the surface (18), and a plurality of screw holes (8), and including a bearing (1) fixed in the axial and radial direction on the bearing flange (2), simple, reliable installation of the sanding disc (5) on the bearing flange (2) is ensured by the fact that the driving lugs (3) and the screw holes (8) are arranged equidistantly relative to each other on a common circle around the central axis of the bearing flange (2).

11 Claims, 3 Drawing Sheets

GRINDING-DISK RECEIVING ELEMENT ESPECIALLY FOR A HAND-GUIDED ELECTRIC GRINDING TOOL

CROSS-REFERENCE

The invention described and claimed hereinbelow is also described in PCT/DE 2004/002126, filed Sep. 24, 2004 and DE 103 52 501.7, filed Nov. 11, 2003. This German Patent Application, whose subject matter is incorporated here by reference, provides the basis for a claim of priority of invention under 35 U.S.C. 119 (a)–(d).

BACKGROUND OF THE INVENTION

The present invention is directed to a sanding-disc receiving element for a hand-guided electric sanding tool.

Sanding-disc receiving elements are known, with which a roller bearing is inserted into a two-part bearing flange, so that the roller bearing is clamped tightly between the two aluminum parts of the bearing flange in the axial and radial direction. This is accomplished using screws that engage through a sanding disc with screw holes in one of the two parts of the bearing flange. The second part of the bearing flange is clamped between the part of the bearing flange with the screw holes, and the sanding disc. The screws pass through guide grooves on the outside of the second part of the bearing flange. A design of this type is expensive to manufacture and difficult to install, however.

It is furthermore known to arrange driving lugs on the surface of the bearing flange facing the sanding disc, the driving lugs projecting above the surface in a circle around the central axis of the bearing flange. Also located on the surface is a row of screw holes arranged on a different circle. By screwing the sanding disc together with the bearing flange, it is entirely possible, however, that the driving lugs will not enter a bore formed in the sanding disc, thereby not ensuring the functionality of the sanding tool.

SUMMARY OF THE INVENTION

In contrast, a sanding-disc receiving element according to the present invention has the advantage that, due to the arrangement of the driving lugs and screw holes on a common circle around the central axis of the bearing flange, combined with the equidistant arrangement of adjacent driving lugs and screw holes, simple installation of a sanding disc is given, since there is a large number of ways to install it. At the same time, the sanding disc cannot be installed in a faulty manner, since the driving lugs always engage in a through hole in the sanding disc.

Due to the fact that the driving lugs are integrally joined with the bearing flange, the entire bearing flange can be produced in a single working step. This is advantageous, in particular, when the bearing flange and the driving lugs are composed of plastic, since only one tool is required to manufacture the entire bearing flange.

Due to the fact that the driving lugs have insertion bevels on their free ends, it is possible to insert these driving lugs in through holes in the sanding disc in a very simple and reliable manner, even if the sanding disc is rotated slightly relative to its end position on the bearing flange.

Due to the fact that the driving lugs and screw holes are arranged in an alternating manner on the circle, good driving of the sanding disc and its secure attachment to the bearing flange are ensured.

Due to the fact that the driving lugs and screw holes have essentially the same diameter, the through holes in the sanding disc can also have the same diameter. As a result, a larger number of possible fixing positions of the sanding disc on the bearing flange is obtained, and installation is simplified as a result.

Due to the fact that a cover disc fixes the bearing—which is located in a recess of the bearing flange—in the axial direction, a method for axially fixing the bearing is obtained in a very simple and economical manner. The bearing is also protected against dust. It is particularly advantageous when the cover disc engages, via an engagement part, in the recess of the bearing flange in the radial direction in a form-locked manner. A very good axial fixing of the bearing on the bearing flange is obtained as a result.

Due to the fact that the cover disc has a collar that is engagable with a central hole in an insertion plate of a sanding disc in the radial direction in a form-locked manner, installation of the sanding disc on the bearing flange is simplified further.

Due to the fact that the cover disc is composed of plastic, electrical insulation from the armature shaft of the electric sanding tool is obtained.

BRIEF DESCRIPTION OF THE DRAWINGS

An exemplary embodiment of the present invention is explained in greater detail in the description below with reference to the associated drawing.

DETAILED DESCRIPTION OF THE PREFERRED EMBODIMENTS

Figure 1:
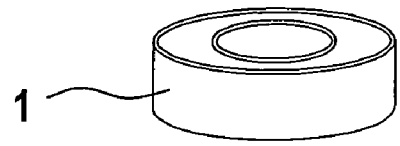
FIG. 1 Shows a perspective illustration of a bearing.

A bearing 1 in the form of a roller bearing is shown in FIG. 1. This bearing 1 serves to connect a drive axis of a hand-guided electric sanding tool with a sanding disc 5 (refer to FIGS. 5 through 7).

Figure 2:
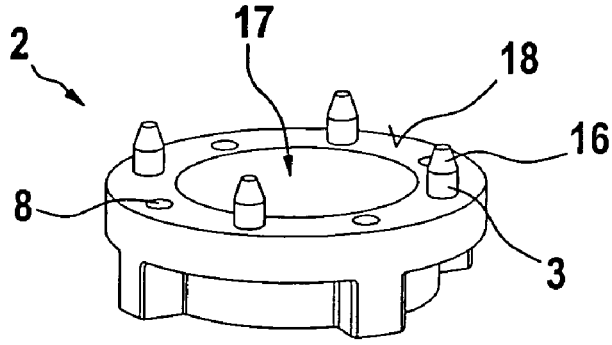
FIG. 2 Shows a perspective view of a bearing flange according to the present invention, FIG. 3 Shows a perspective illustration of a sanding-disc receiving element according to the present invention, with which the two objects described in FIGS. 1 and 2 are assembled, FIG. 4 Shows a side view of a cover disk, FIG. 5 Shows a top view of a sanding disc, FIG. 6 Shows an eccentric sander with a sanding-disc receiving element—as shown in FIG. 3—according to the present invention installed, and with a sanding disc yet to be installed, and FIG. 7 Shows an eccentric sander as depicted in FIG. 6, with the sanding disc installed.

A bearing flange 2 according to the present invention is shown in FIG. 2. Four driving lugs 3 projecting outward in the axial direction are formed on its surface 18 facing sanding disc 5. Surface 18 also has four screw holes 8.

Figure 3:
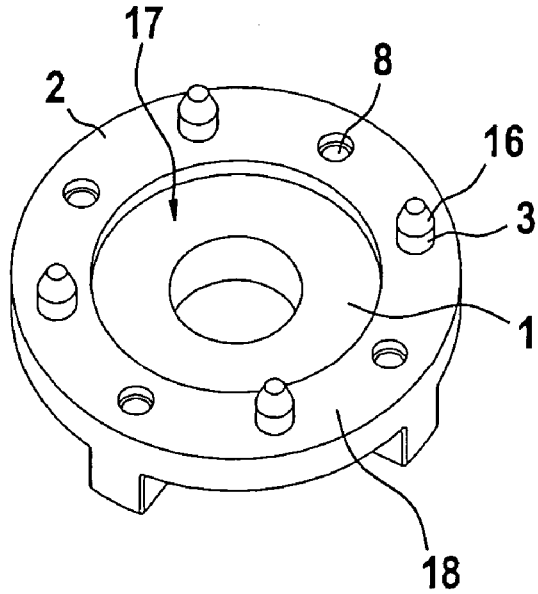

The spacial arrangement of driving lugs 3 and screw holes 8 is shown clearly in the view in FIG. 3, in which bearing 1 is radially fixed in a recess 17 of bearing flange 2 using a press fit.

Driving lugs 3 and screw holes 8 are arranged on a common circle around the central axis of bearing flange 2. The distances between adjacent driving lugs 3 and screw holes 8 are equal in every case. In addition, the driving lugs 3 and screw holes 8 are always arranged in an alternating manner on the circle. One screw hole 8 is therefore always located between two driving lugs 3, and vice versa.

An insertion bevel 16 is formed on each of the driving lugs 3, on their free ends. As a result, sanding disc 5 can be screwed to bearing flange 2 more easily (refer to FIGS. 6 and 7).

Bearing flange 2 is preferably integrally joined with driving lugs 3, all composed of plastic. As a result, it is very lightweight and easy and economical to manufacture. For example, it can be manufactured using a single injection-moulding procedure and a single injection-moulding tool.

Figure 4:
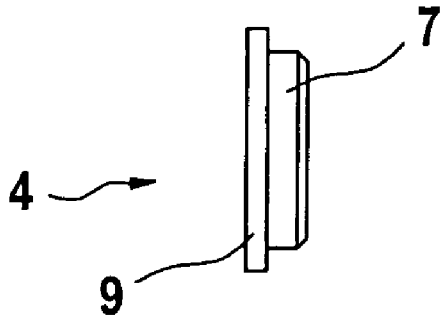

A cover disc 4 with an engagement part 7 and a collar 9 is shown in FIG. 4. Cover disc 4 is preferably composed of plastic, since this allows it to be very lightweight and easy and economical to manufacture. In addition, this also enables sanding disc 5 to be electrically insulated from an armature shaft (not shown) of eccentric sander 15. Additional details that illustrate how cover disc 4 interacts with bearing flange 2 and sanding disc 5 are shown in FIGS. 6 and 7, and are described below.

Figure 5:
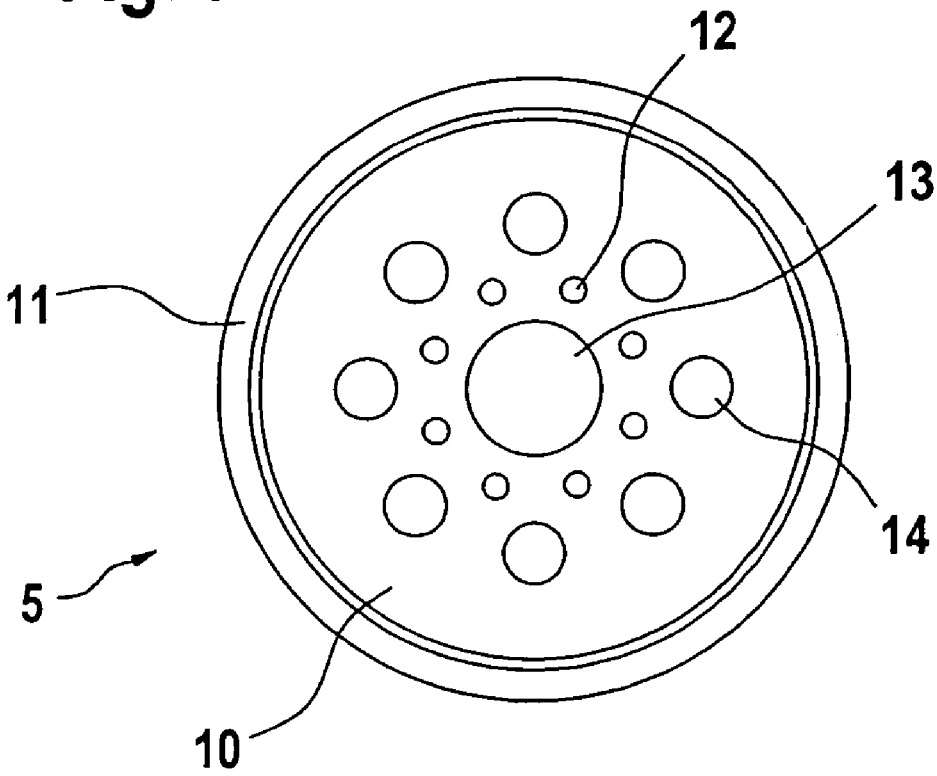
Figure 6:
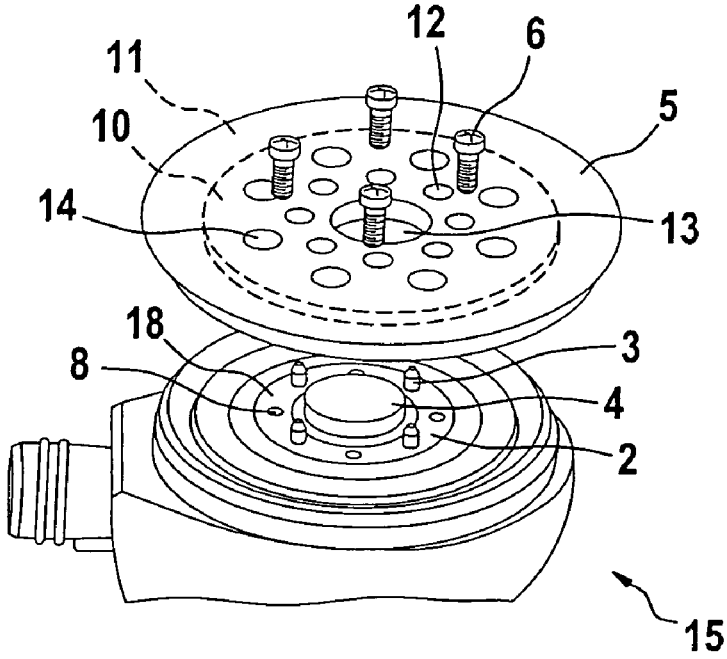
Figure 7:
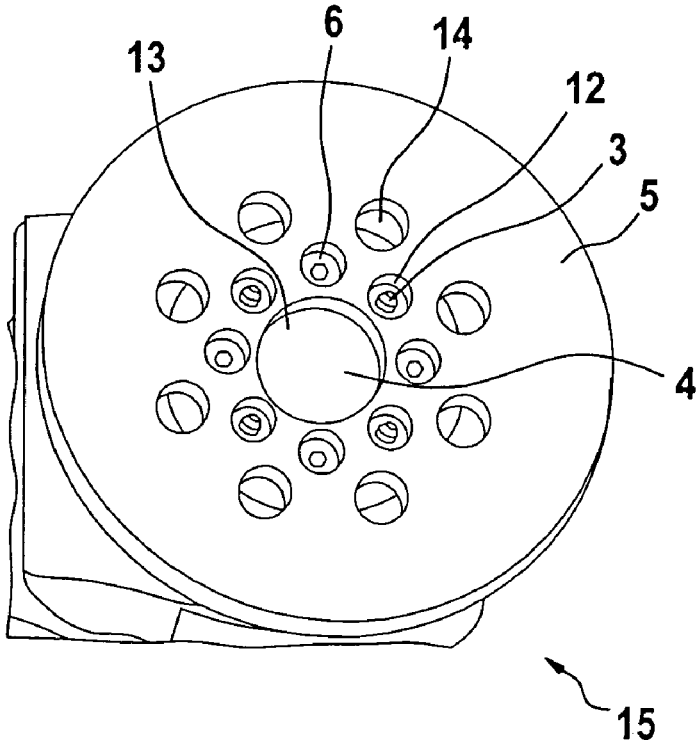

A sanding disc 5 is shown in FIG. 5, the sanding disc 5 being screwed to bearing flange 2 (refer to FIGS. 6 and 7). Sanding disc 5 includes an insertion plate 10 that is preferably composed of plastic. Insertion plate 10 has a central hole 13 and suction holes 14 located on a circle around the central axis of insertion plate 10.

In addition, a total of eight through holes 12—arranged equidistantly relative to each other—is located on a further circle around the central axis of insertion plate 10. The radius of this circle corresponds exactly to the radius of the circle on which the driving lugs 3 and screw holes 8 of bearing flange 2 are located. As a result, through holes 12 of sanding disc 5 can be lined up with the driving lugs 3 and screw holes 8 of bearing flange 2. Further details about this and the installation of sanding disc 5 on bearing flange 2 are described below with reference to FIGS. 6 and 7.

Insertion plate 10 is enclosed in a foam padding 11 in a known manner. Since this is not essential to the present invention, it will not be discussed in further detail here.

FIG. 6 shows a preinstalled eccentric sander 15 in which a sanding-disc receiving tool according to the present invention (refer to FIG. 3) has already been installed. In addition, cover disc 4 is inserted in bearing flange 2 of sanding-disc receiving element according to the present invention. Engagement part 7 (refer to FIG. 4) of cover disc 4 engages here in recess 17 (refer to FIG. 2) of bearing flange 2 and fixes bearing 1 in the axial direction relative to bearing flange 2. As a result, only collar 9 of cover disc 4 projects above surface 18 of bearing flange 2. Cover disc 4 thereby not only provides electrical insulation from the armature shaft, but also protects bearing 1 from dust penetration, which results in a longer service life of bearing 1.

Cover disc 4 serves as a centering aid for installation of sanding disc 5 on bearing flange 2, since it can be easily seen through the central hole 13 in sanding disc 5. Sanding disc 5 need therefore only be arranged correctly in terms of its angular position, so driving lugs 3 engage in through holes 12 and it can be fixed using screws 6. Screws 6 are preferably four moulded plastic screws. Insertion bevels 16 on driving lugs 3 further ensure correct placement in terms of the angle of sanding disc 5 on bearing flange 2.

In the final installed state of eccentric sander 15 with sanding disc 5 shown in FIG. 7, it is easy to see that all four driving lugs 3 and all four screws 6 are located in through holes 12. In addition, collar 9 of cover disc 4 and central hole 13 of sanding disc 5 are matched to each other such that collar 9 engages with central hole 13 in the radial direction in a form-locked manner.

Locating the correct angle is further simplified by the fact that there are eight possibilities—regarding the angle—in which sanding disc 5 can be joined with bearing flange 2. This means that installation can occur at every 45° angle.

It is obvious that the present invention is definitely not limited to a total of eight through holes 12 in sanding disc 5, four driving lugs 3 and four screw holes 8. A larger of smaller number of driving lugs 3 and screw holes 8 can be selected just as easily. It is also possible to select a different sequence of driving lugs 3 and screw holes 8.

The only essential feature of the present invention is that driving lugs 3 and screw holes 8 are located on a common circle around the central axis of bearing flange 2 and are arranged equidistantly relative to each other. It does not matter if a through hole 12 meets a driving lug 3 or a screw hole 8. In summary, it can be stated that, with a sanding-disc receiving element according to the present invention, very simple installation of sanding disc 5 on bearing flange 2 is made possible, while preventing faulty installation.

What is claimed is:

1. A sanding-disc receiving element for a hand-guided eccentric sander (15), the sanding-disc receiving element including a bearing flange (2) with a plurality of driving lugs (3) protruding in the axial direction around the surface (18), and a plurality of screw holes (8), and including a bearing (1) fixed in the axial and radial direction on the bearing flange (2), wherein four driving lugs (3) and four screw holes (8) are arranged equidistantly relative to each other on a common circle around the central axis of the bearing flange (2), wherein the driving lugs (3) are integrally joined with the bearing flange (2), wherein the driving lugs (3) have insertion bevels (16) arranged on their free ends, and wherein the driving lugs (3) and screw holes (8) are arranged in an alternating manner on the circle.

2. The sanding-disc receiving element as recited in claim 1, wherein the bearing flange (2) and the driving lugs (3) are composed of plastic.

3. The sanding-disc receiving element as recited in claim 1, wherein the driving lugs (3) and the screw holes (8) have essentially the same diameter.

4. The sanding-disc receiving element as recited in claim 1, wherein a cover disc (4) fixes the bearing (1) located in a recess (17) in the bearing flange (2) in the axial direction.

5. The sanding-disc receiving element as recited in claim 4, wherein the cover disc (4) engages via an engagement part (7) in the recess (17) of the bearing flange (2) in the radial direction in a form-locked manner.

6. The sanding-disc receiving element as recited in claim 1, wherein the cover disc (4) has a collar (9) that is engagable with a central hole (13) of an insertion plate (10) of a sanding disc (5) in the radial direction in a form-locked manner.

7. The sanding-disc receiving element as recited in claim 4, wherein the cover disc (4) is composed of plastic.

8. A sanding-disc receiving element for a hand-guided electric sanding tool, the sanding-disc receiving element including a bearing flange (2) with a plurality of driving lugs (3) protruding in the axial direction around the surface (18), and a plurality of screw holes (8), and including a bearing (1)

fixed in the axial and radial direction on the bearing flange (2), wherein the driving lugs (3) and the screw holes (8) are arranged equidistantly relative to each other on a common circle around the central axis of the bearing flange (2), and wherein a cover disc (4) fixes the bearing (1) located in a recess (17) in the bearing flange (2) in the axial direction.

9. The sanding-disc receiving element as recited in claim 8, wherein the cover disc (4) engages via an engagement part (7) in the recess (17) of the bearing flange (2) in the radial direction in a form-locked manner.

10. The sanding-disc receiving element as recited in claim 8, wherein the cover disc (4) has a collar (9) that is engagable with a central hole (13) of an insertion plate (10) of a sanding disc (5) in the radial direction in a form-locked manner.

11. The sanding-disc receiving element as recited in claim 8, wherein the cover disc (4) is composed of plastic.

* * * * *